US007611428B2

(12) United States Patent
Mathew et al.

(10) Patent No.: US 7,611,428 B2
(45) **Date of Patent: *Nov. 3, 2009**

(54) BAT WITH FLEXIBLE HANDLE

(75) Inventors: Biju Mathew, St. Charles, MO (US); Matthew V. Vacek, Brownsville, MN (US)

(73) Assignee: Miken Sports, LLC, Caledonia, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/107,452

(22) Filed: Apr. 22, 2008

(65) Prior Publication Data

US 2008/0214338 A1 Sep. 4, 2008

Related U.S. Application Data

(63) Continuation of application No. 11/549,776, filed on Oct. 16, 2006, now Pat. No. 7,377,868.

(60) Provisional application No. 60/745,309, filed on Apr. 21, 2006.

(51) Int. Cl.
*A63B 59/06* (2006.01)

(52) U.S. Cl. ..... 473/568

(58) Field of Classification Search ..... 473/457, 473/519, 520, 564–568
See application file for complete search history.

(56) References Cited

U.S. PATENT DOCUMENTS

| | | | |
|---|---|---|---|
| 729,639 | A | 6/1903 | McCoy |
| 838,257 | A | 12/1906 | Kinst |
| 1,025,478 | A | 5/1912 | Murphy |
| 2,340,156 | A | 1/1944 | Taylor |
| 2,983,512 | A | 5/1961 | Fleischer |
| 3,990,699 | A | 11/1976 | Urmston |
| 4,331,330 | A | 5/1982 | Worst |
| 4,572,508 | A | 2/1986 | You |
| 4,930,772 | A | 6/1990 | Maloney et al. |
| 5,088,733 | A | 2/1992 | Barnes |
| 5,122,405 | A | 6/1992 | Landi |
| 5,131,651 | A | 7/1992 | You |
| 5,150,897 | A | 9/1992 | Wortman |
| 5,348,296 | A | 9/1994 | Frederiksen |
| 5,766,104 | A | 6/1998 | Albarelli, Jr. |
| 6,022,282 | A | 2/2000 | Kennedy et al. |
| 6,048,283 | A | 4/2000 | Albarelli, Jr. |
| 6,176,795 | B1 | 1/2001 | Schullstrom |
| 6,425,836 | B1 | 7/2002 | Misono et al. |

(Continued)

FOREIGN PATENT DOCUMENTS

| | | |
|---|---|---|
| GB | 2067079 | 7/1981 |

(Continued)

*Primary Examiner*—Mark S Graham
(74) *Attorney, Agent, or Firm*—Waddey & Patterson, P.C.; Phillip E. Walker

(57) ABSTRACT

Included herein is a bat for striking a ball. The bat comprises a barrel portion, transition portion attached to the barrel portion, and a handle portion attached to the transition portion. The handle portion includes a longitudinal axis and a plurality of planes substantially parallel to the axis. The adjacent planes of the plurality of planes are positioned to define apertures substantially parallel to the axis. The planes and apertures are positioned to vary the flexibility of the handle and improve bat performance for a given swing speeds.

5 Claims, 7 Drawing Sheets

U.S. PATENT DOCUMENTS

| | | | |
|---|---|---|---|
| 6,485,382 | B1 | 11/2002 | Chen |
| 6,497,631 | B1 | 12/2002 | Fritzke et al. |
| D482,749 | S | 11/2003 | Gumpel |
| 6,669,584 | B1 | 12/2003 | Miller |
| 6,733,404 | B2 | 5/2004 | Fritzke et al. |
| 6,761,653 | B1 | 7/2004 | Higginbotham et al. |
| 7,207,907 | B2 | 4/2007 | Guenther et al. |
| 2002/0016230 | A1 | 2/2002 | Okuyama et al. |
| 2006/0128508 | A1 | 6/2006 | Casasanta, Jr. |
| 2006/0293130 | A1 | 12/2006 | Guenther et al. |

FOREIGN PATENT DOCUMENTS

| | | |
|---|---|---|
| JP | 5023407 | 2/1993 |

BAT WITH FLEXIBLE HANDLE

This application is a continuation of U.S. patent application Ser. No. 11/549,776 entitled "Bat With Flexible Handle" filed Oct. 16, 2006, is a non-provisional claiming priority to U.S. Provisional Patent Application Ser. No. 60/745,309 entitled "Bat With Flexible Handle" filed Apr. 21, 2006.

All applications and patents previously or subsequently mentioned are hereby expressly incorporated by reference in their entireties.

We, Matthew V. Vacek, a citizen of the United States, residing at P. O. Box 18, Brownsville, Minn. 55919; Biju Mathew, a citizen of India, residing at 4128 Stonecroft Drive, St. Charles, Mo. 63304; have invented a new and useful "Bat With Flexible Handle."

BACKGROUND OF THE INVENTION

The current invention relates long handled sports equipment, such as softball or baseball bats, for striking balls. More particularly, the current invention pertains to designs for bats that yield a particular cross-sectional shape to improve the hitting characteristics thereof.

It can be appreciated that numerous attempts have been made to improve the performance of a bat. These prior attempts have included the addition of various shells, inserts, materials, and shapes of the bat in order to improve its performance or usage. For example, U.S. Pat. Nos. 6,761,653, 6,733,404, 6,497,631, 6,425,836, 6,176,795, 6,022,282, 4,930,772, 4,331,330, and 3,990,699, U.S. Patent Application Publication No. 2002/0016230, and Japanese Patent No. JP5023407 disclose various attempts to improve the performance or use of a bat.

The performance of a bat is generally based upon the weight of the bat, length of the bat, and the impact response of the bat at and during impact with a ball. The weight and length characteristics of bats have practical, as well as batter preference, limitations. As such, most prior art attempts to improve bat technology have been focused on the impact response of the bat at and during impact with a ball.

For example, studies have been made to measure the coefficient of restitution (COR) between a ball and a bat. The research has shown that the COR was dependent on both the flexural stiffness, with reference to the axis of a bat, and the circumferential stiffness, or elasticity, of the bat. The research found that the COR rose with increasing bending stiffness and decreasing circumferential stiffness.

Other research has shown that the elasticity of the bat is a greater factor in determining the COR of the bat. For example, research has shown that when the contact time between the ball and the bat match the time required for the bat to deflect and return to its original position, the COR increases because some of the vibrational energy in the bat was returned to the ball. This has been referred to an isoharmonic impact.

It is known that as the weight of a bat is reduced, the batter can swing the bat with additional speed thereby parting more force on the ball during impact. Bat performance therefore varies with the individual player's swing speed. Additionally, other research has shown that the performance factors of a bat can be increased when the bending momentum in the bat is increased.

It is theorized that the speed of the bat, and more particularly the speed of the hitting area of the bat, through the hitting zone can be affected by the relative flexibility between the handle and the barrel, or flexibility in the attachment between the handle and barrel depending on the overall swing speed of the bat. An important location for the actual measurement of overall bat swing speed is in the hitting zone—roughly defined by the strike zone for each individual batter. In essence, it is theorized that handle flexibility and can affect the relative speed of the barrel through the hitting zone even if the overall speed of the bat is substantially consistent. For example, it is theorized that a player with high swing speed can get a better performance with a stiff handle bat, where as a player with lower swing speed will perform better with a flexible handle bat provided all the parameters remains the same. For example, a professional player should perform better with a stiff handle bat compared to a high school player, who should perform better with a flexible handle bat What is needed is an improved bat that provides increased performance. This improved bat preferably has a design that alters flexibility characteristics such that it has an improved batted ball performance. This needed bat is lacking in the art.

SUMMARY OF THE INVENTION

Included herein is a bat for striking a ball. The bat comprises a barrel portion, transition portion attached to the barrel portion, and a handle portion attached to the transition portion. The handle portion includes a longitudinal axis and a plurality of planes substantially parallel to the axis. The adjacent planes of the plurality of planes are positioned to define apertures substantially parallel to the axis.

The bat further includes a cross piece which is perpendicular to the plurality to the planes that intersects the axis. The cross piece further includes a thickness and a length wherein the thickness is substantially uniform along the length. Each aperture further includes a proximate end. In one embodiment, the proximate ends are aligned. In an alternate embodiment, at least two of the proximate ends are off set.

Each plane can further include a distal end with each end substantially round in shape. Additionally, the handle can include a circumference wherein the distal ends conform to the shape of the circumference. A layer of material can be positioned around the handle to enclose the apertures and planes.

The handle can further include a deflection characteristic responsive to a force positioned substantially perpendicular to the longitudinal axis. The deflection characteristic is increased by the apertures defined in the handle such that the apertures increase the deflection characteristic in the handle during operation of the bat when it strikes a ball.

It is therefore a general object of the present invention to provide an improved bat for striking a ball.

Another object of the present invention is to provide a bat having a handle portion that includes a plurality of planes positioned substantially parallel to the axis of a handle.

Another object of the present invention is to provide a bat with an improved deflection characteristic in the handle of the bat.

Other further objects and features of the current invention will be readily apparent upon a reading of the detailed disclosure and a view of the figures included herein.

BRIEF DESCRIPTION OF THE DRAWINGS

FIG. 11 shows an example of a handle with three types of flexibility depending on the orientation of the impact between the ball and bat in view of the orientation of the planes of the handle.

FIG. 13A shows an example of a handle have external supports varying flexibility of the handle.

FIG. 13B shows an example of a handle have alternate external supports varying flexibility of the handle.

DETAILED DESCRIPTION OF THE PERFERRED EMBODIMENTS

Figure 1:
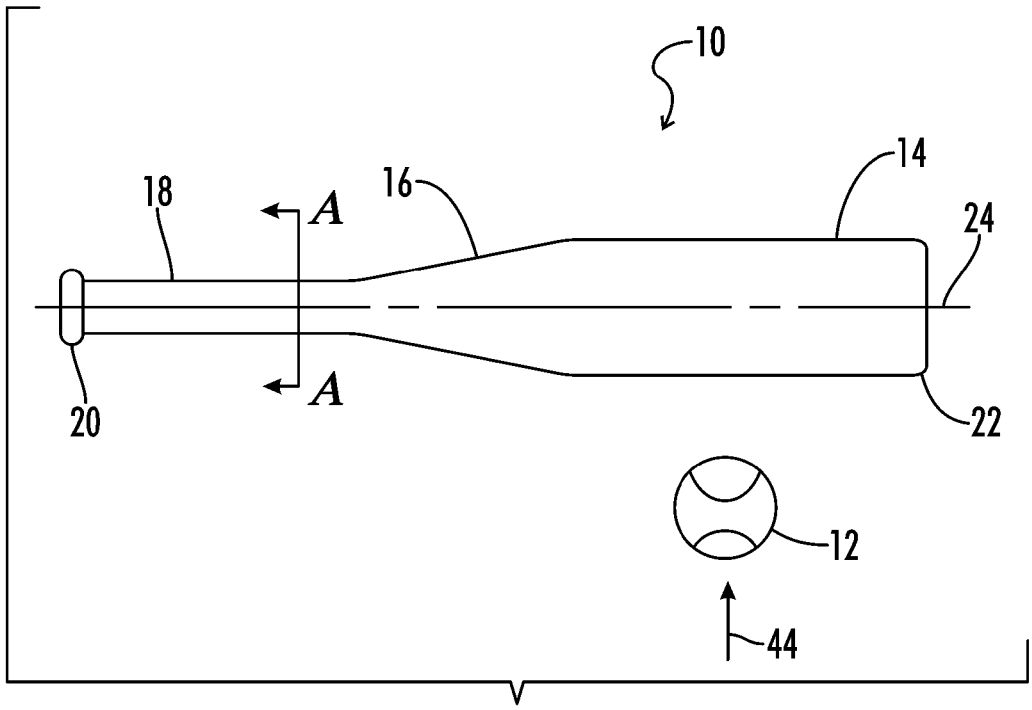
FIG. 1 is a side view of a bat made in accordance with the current disclosure.
Figure 2:
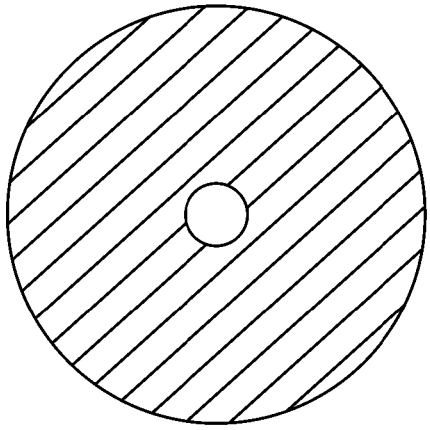
FIG. 2 (PRIOR ART)
FIG. 2 is a cross-sectional view of a prior art bat taken generally along line AA as shown in FIG. 1.
Figure 3:
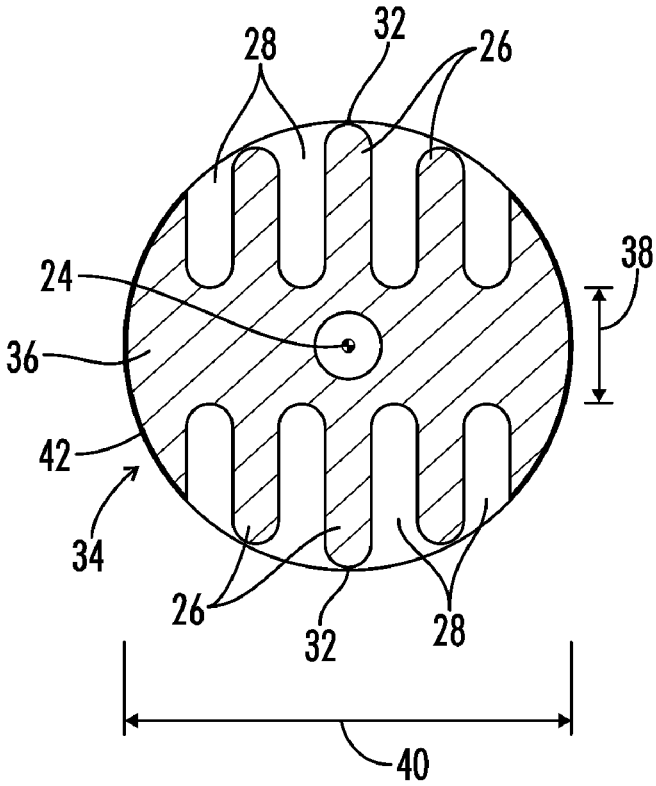
FIG. 3 is a cross-sectional view of an embodiment of a bat made in accordance with the current disclosure taken generally along AA of FIG. 1.
Figure 4:
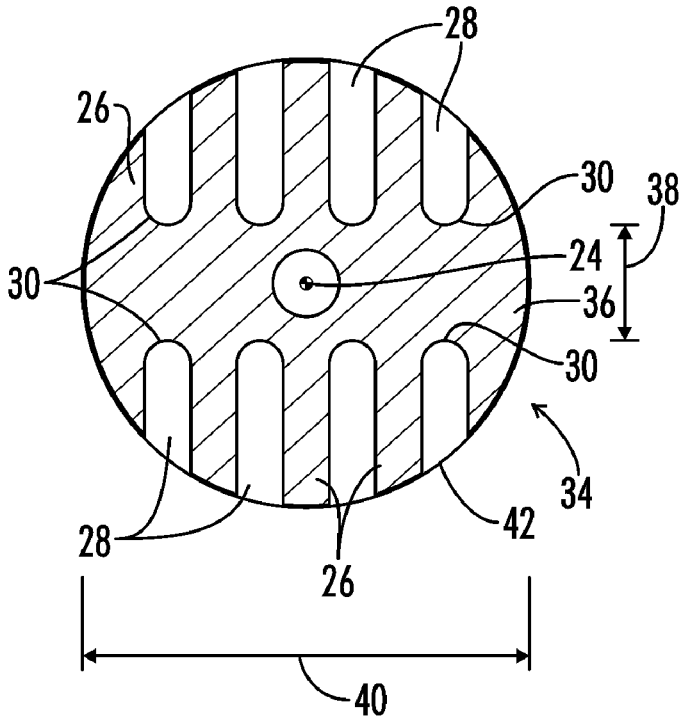
FIG. 4 is a cross-sectional view of an embodiment of a bat made in accordance with the current disclosure taken generally along AA of FIG. 1.
Figure 5:
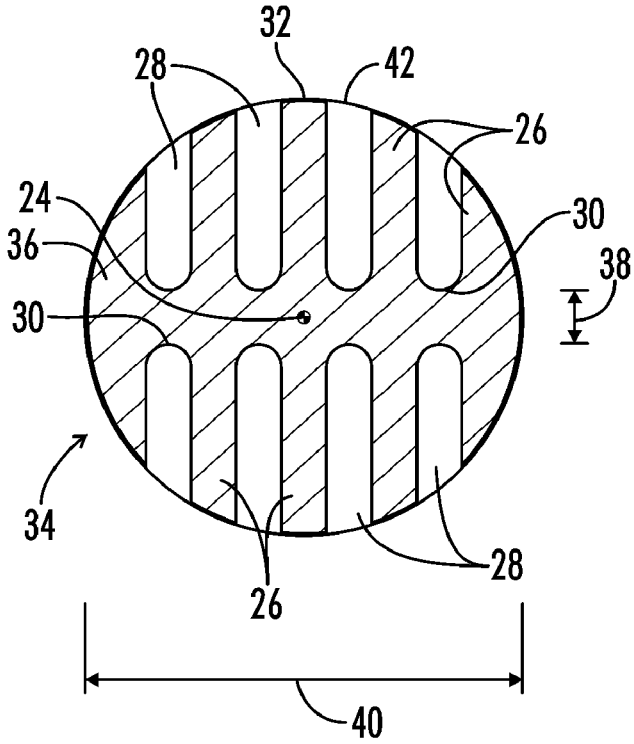
FIG. 5 is a cross-sectional view of an embodiment of a bat made in accordance with the current disclosure taken generally along AA of FIG. 1.
Figure 6:
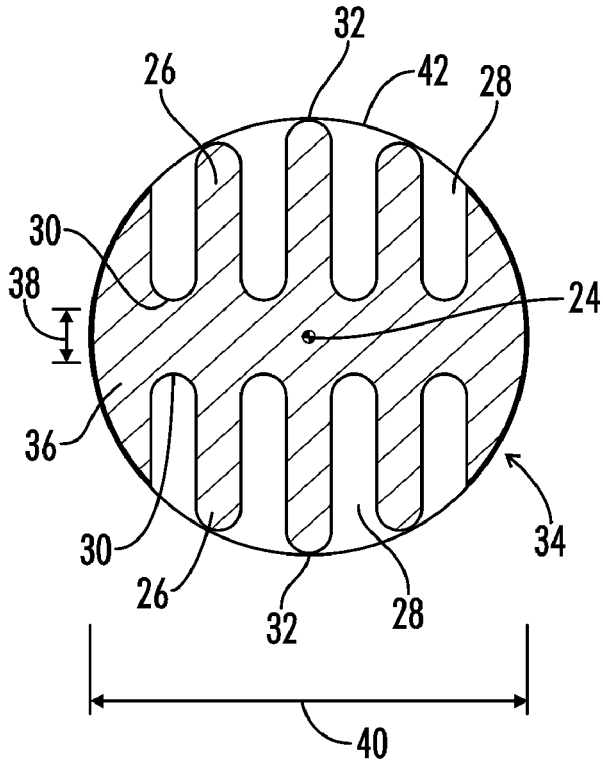
FIG. 6 is a cross-sectional view of an embodiment of a bat made in accordance with the current disclosure taken generally along AA of FIG. 1.
Figure 7:
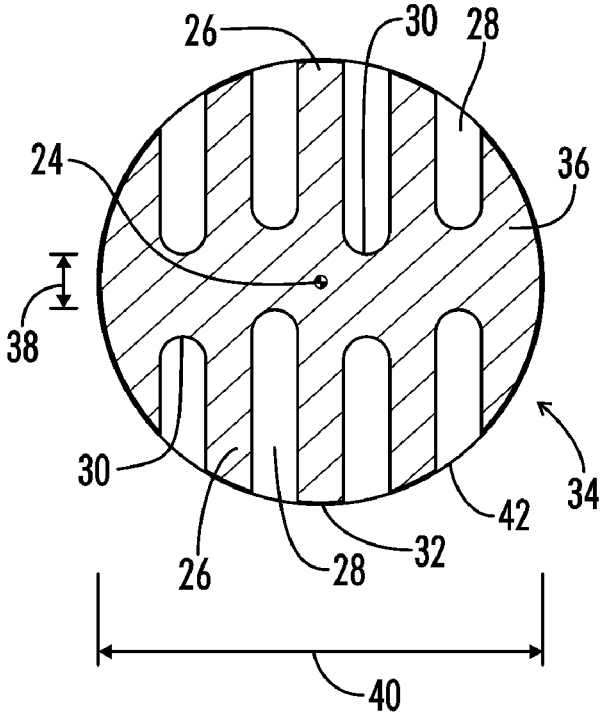
FIG. 7 is a cross-sectional view of an embodiment of a bat made in accordance with the current disclosure taken generally along AA of FIG. 1.
Figure 8:
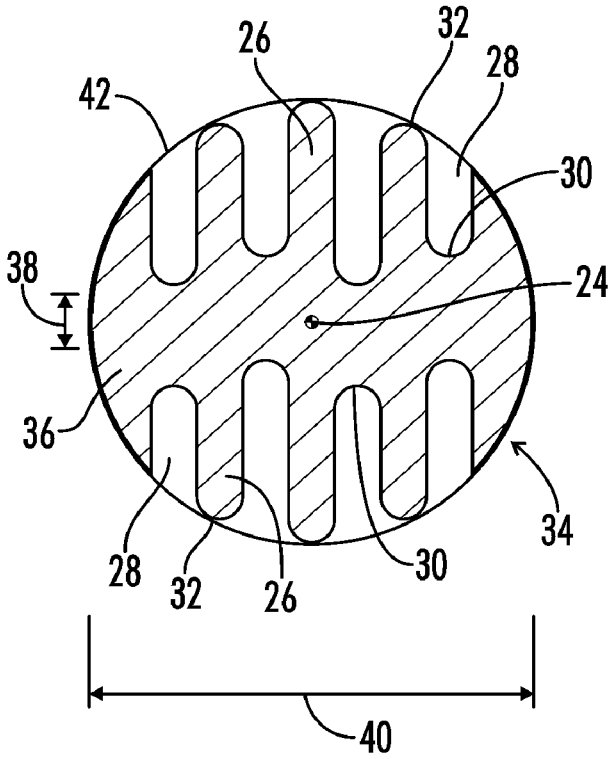
FIG. 8 is a cross-sectional view of an embodiment of a bat made in accordance with the current disclosure taken generally along AA of FIG. 1.
Figure 9:
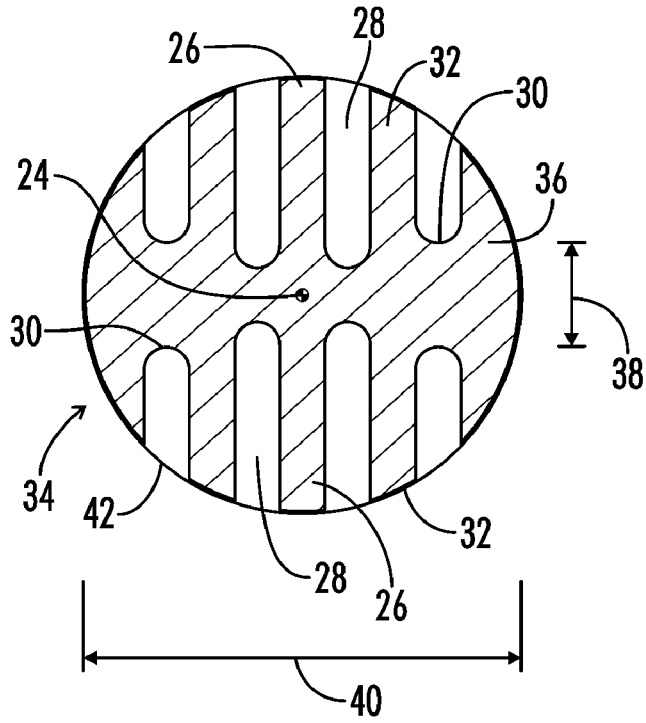
FIG. 9 is a cross-sectional view of an embodiment of a bat made in accordance with the current disclosure taken generally along AA of FIG. 1.
Figure 10:
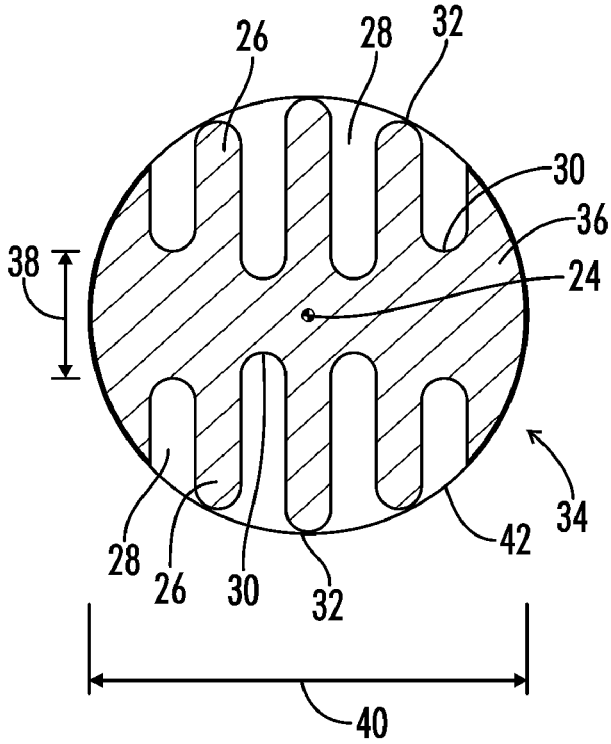
FIG. 10 is a cross-sectional view of an embodiment of a bat made in accordance with the current disclosure taken generally along AA of FIG. 1.

Referring generally now to FIGS. 1-13B, a bat is shown generally designated by the numeral 10. The bat 10 is for striking a ball 12 and comprises a barrel portion 14, a transition portion 16, and a handle portion 18. The transition portion 16, which can also be described as a taper 16, is attached to the barrel portion 14, which can also be described as a barrel 14, while the handle portion 18, which can also be described as a handle 18, is attached to the transition portion 16. The bat also includes a knob 20 and a cap end 22.

The handle portion 18 includes a longitudinal axis 24, which can also be described as a central axis 24, and a plurality of planes 26, which can be described as a plurality of second planes 26, positioned substantially parallel to the axis 24. The plurality of planes 26 are positioned such that adjacent planes define apertures 28 wherein the apertures 28 are substantially parallel to the axis 24. Each aperture 28 includes a proximate end 30, while each plane 26 includes a distal end 32.

In one embodiment, each proximate end 30 is aligned with one of the adjacent proximate ends 30, while in another embodiment at least two of the proximate ends 30 are offset. In another embodiment, each distal end 32 is rounded. These rounded distal ends 32 can be generally described as tapering to a curved point. In another embodiment, the distal ends 32 conform to the shape of the circumference 34 of the handle 18.

The handle 18 can also include a cross piece 36, which can also be described as a first plane of material 36, that is positioned substantially perpendicular to the planes 26 and substantially intersecting the axis 24. The cross piece 36 can further include a thickness 38 and a length 40. In one embodiment, the thickness 38, which can be described as a width 38, is substantially uniform along the length 40. In an alternate embodiment, the width 38 varies along the length 40.

The bat 10 can further include a layer of material 42 that surrounds the handle 18. The layer of material 42 can be used to enclose the handle 18 and protect the handle 18 without altering the characteristics of the bat 10.

The handle 18 further includes a deflection characteristic which is responsive to a force 44 applied substantially perpendicular to the axis 24. The deflection characteristic of the handle 18 is increased by the apertures 28 defined in the handle 14 by the planes 26 and cross piece 36. Part of this increased deflection characteristic is due to the fact that the apertures 28 open to the circumference 34 of the handle 18. This allows deflection between the planes 26 when the force 44 is applied to the bat 10. As such, due to the positioning of the planes 26 to create the apertures 28, the planes 26 have additional room in which to deflect during the application of the force 24. This additional deflection allows for an increased overall elasticity of the bat 10 and a return of energy to the ball 12.

Figure 11:
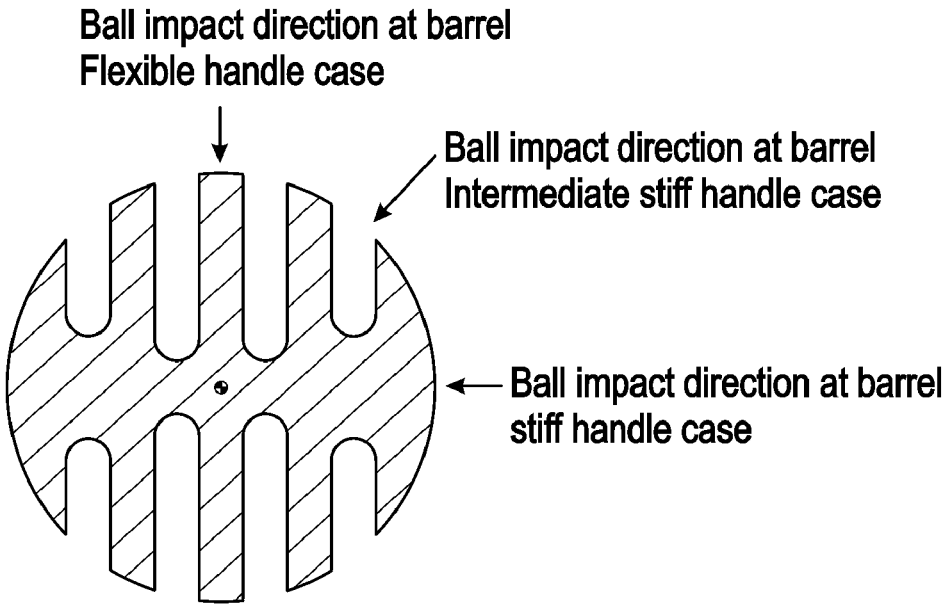
FIG. 11 is a cross-sectional view of an embodiment of a bat made in accordance with the current disclosure taken generally along AA of FIG. 1.
Figure 12:
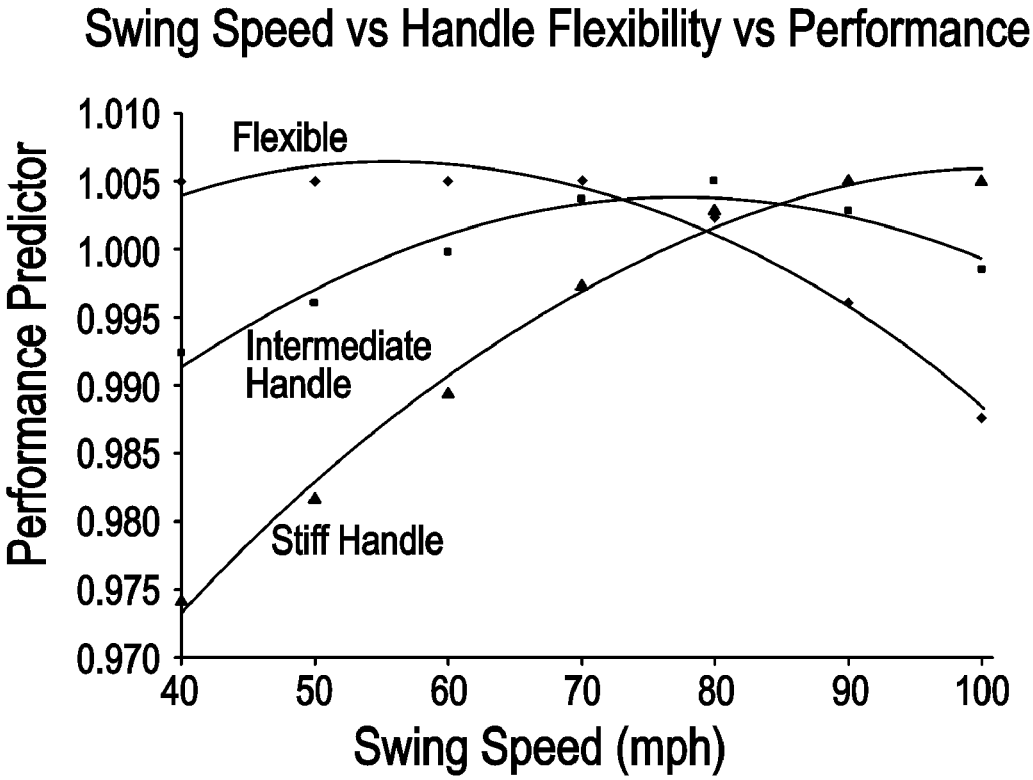
FIG. 12 is graph showing the comparison of swing speed and performance for three types of flexibility in handles.

As illustrated in FIGS. 11 and 12, the performance of various embodiments of the current invention can vary depending on the orientation of the handle 14 in relation to the impact direction of the ball and the bat. For example impact of ball in a direction substantially perpendicular to the planes 26 and substantially planer to the cross piece 36 provides a stiff response from the handle 14. Impact of ball in a direction substantially parallel to the planes 26 and substantially perpendicular to the cross piece 36 provides a flexible response from the handle 14. Additionally, impact of ball in a direction obtuse to both to the planes 26 and cross piece 36 provides an intermediate response from the handle 14. FIG. 12 provides test data of the various responses charted against swing speed of the bat and performance of the bat.

Additionally, the cylindrical nature of the handle 18 further facilitates the same integration of the current inventive bat 10 into the market. A layer 42 can substantially cover the handle 18 such that a user of the bat 10 would not necessarily know of the unique design feature of the handle 18.

Figure 13A:
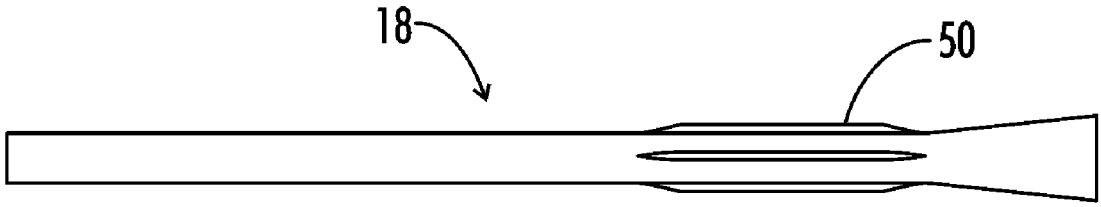
FIG. 13A is a partial side view of a handle made in accordance with the current disclosure.
Figure 13B:
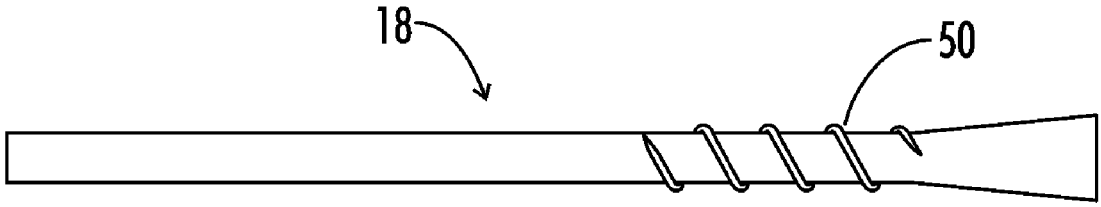
FIG. 13B is a partial side view of a handle made in accordance with the current disclosure.

As exampled in FIGS. 13A-B, in an alternate embodiment of the bat 10 the handle 18 includes externally positioned supports 50 positioned on the handle 18 to regulate the flexibility of the handle 18. The supports 50, or ribs 50, can be positioned in several configurations including substantially parallel to the axis of the handle and circumferentially positioned on the circumference of the handle 18. Alternately, the ribs 50 can be spirally shaped along the length of the bat.

The supports 50 are preferably positioned to regulate the flexibility, or define the stiffness characteristics, of the handle 18. This can be accomplished by connecting adjacent planes 26 to inhibit independent movement there between. The ribs 50 can run longitudinally (parallel to the main axis of the bat 10) and be used to efficiently increase stiffness. Alternately, the ribs 50 can spiral or angle down the handle 18 to provide varying degrees of stiffness in the handle 18. Adding the ribs 50 to the outside of the handle 18 facilitates the controlled stiffness of the handle 18 due to the fact that the reinforcement characteristics of the ribs 50 are space from the neutral axis of bending of the bat 10.

Thus, although there have been described particular embodiments of the present invention of a new and useful Bat With Flexible Handle, it is not intended that such references be construed as limitations upon the scope of this invention except as set forth in the following claims.

What is claimed is:

1. A bat for striking a ball, the bat comprising:

a barrel;

a taper attached to the barrel; and a handle attached to the taper, the handle including:

a circumference;

a central axis;

a plurality of longitudinal planes of material substantially parallel to the axis, wherein adjacent longitudinal planes are positioned to define longitudinal apertures substantially parallel to the axis;

a connecting piece substantially perpendicular to the plurality of longitudinal planes and intersecting the axis, the connecting piece including a width and a length, wherein the width varies along the length.

2. The bat of claim 1, wherein the handle further includes:

a deflection characteristic responsive to a force substantially perpendicular to the central axis, the deflection characteristic increased by the apertures defined in the handle.

3. The bat of claim 1, wherein each longitudinal aperture further includes a proximate end, each longitudinal plane further includes a distal end, and at least two of the proximate ends are offset.

4. The bat of claim 3, wherein the distal ends are rounded.

5. The bat of claim 3, wherein the distal ends conform to the shape of the circumference.

* * * * *